US005248271A

United States Patent [19]

Chu

[11] Patent Number: 5,248,271

[45] Date of Patent: Sep. 28, 1993

[54] BUILT-UP WATERCRAFT

[76] Inventor: Yung-Pao Chu, 12F-2, No. 112, Sec. 2, Chung Shan N. Rd., Taipei, Taiwan

[21] Appl. No.: 968,422

[22] Filed: Oct. 29, 1992

[51] Int. Cl.[5] ..... B63H 1/04

[52] U.S. Cl. ..... 440/90; 440/6; 440/12; 114/353; 114/249

[58] Field of Search ..... 440/6, 12, 90; 114/61, 114/77 R, 249, 250, 353

[56] References Cited

U.S. PATENT DOCUMENTS

| | | | |
|---|---|---|---|
| 643,678 | 2/1900 | Perry | 440/12 |
| 691,805 | 1/1902 | Perry | 440/90 X |
| 1,714,908 | 5/1929 | Heisler | 440/6 |
| 3,818,854 | 6/1974 | Marriner | 114/249 |

FOREIGN PATENT DOCUMENTS 0261468 11/1926 United Kingdom ..... 114/353

*Primary Examiner*—Sherman Basinger

*Attorney, Agent, or Firm*—Jacobson, Price, Holman & Stern

[57] ABSTRACT

A built-up watercraft includes a body consisted of three base boards hinged together and bilaterally supported on two floats by two wings, two propeller runners bilaterally coupled to a transmission mechanism mounted on the body at the back, a rudder assembly fastened to the body below the transmission mechanism, a steering wheel assembly mounted on the body at the front and driven to adjust the direction of the rudder assembly. The three base boards of the body and the wings are folded up and formed into the shape of a case as the watercraft is not in use. Connecting tubes are made on the wings and the body for permitting a plurality of watercrafts of the same structure to be connected in series as well as in parallel by flexible connecting rods.

7 Claims, 6 Drawing Sheets

BUILT-UP WATERCRAFT

BACKGROUND OF THE INVENTION

The present invention relates to a built-up watercraft for water sports which can be conveniently set up into shape for independent use or combined with other watercrafts of the same structure longitudinally as well as transversely into a big scale of watercraft for a team game, and which can be conveniently folded up to reduce the size for carrying.

A conventional double-hull type watercraft or water cycle is generally comprised of an elongated deck board supported on two spaced hulls. The deck board has two opposite ends respectively fastened to the hulls by steel bars and screws. This structure of watercraft or water cycle is not convenient to assemble or disassemble. Although the deck board can be detached from the hulls for carrying separately when the watercraft or water cycle is not in use, the elongated size of the deck board is still not convenient to carry. Furthermore, conventional watercrafts or water cycles can not be coupled one another forming into a big scale watercraft or water cycle for a team game.

SUMMARY OF THE INVENTION

The present invention has been accomplished under the aforesaid circumstances. It is therefore an object of the present invention to provide a built-up watercraft for water sports which can be conveniently set up into shape or collapsed. It is another object of the present invention to provide a built-up watercraft for water sports which can be folded up to reduce the storage size as it is not in use. It is still another object of the present invention to provide a built-up watercraft for water sports which can be coupled to other watercrafts of the same structure longitudinally as well as transversely for a team game. According to the preferred embodiment of the present invention, the body of the watercraft is comprised of a master base board hinged between two auxiliary base boards in longitudinal direction and two wings in transverse direction and bilaterally supported on two floats. As the watercraft is not in use, the base boards and the wings are folded up and formed into the shape of a case for holding the other parts of the watercraft. Connecting tubes are made on the wings and the auxiliary base boards of the body for permitting a plurality of watercrafts of the same structure to be connected in series as well as in parallel by flexible connecting rods.

DETAILED DESCRIPTION OF THE PREFERRED EMBODIMENTS

Figure 1:
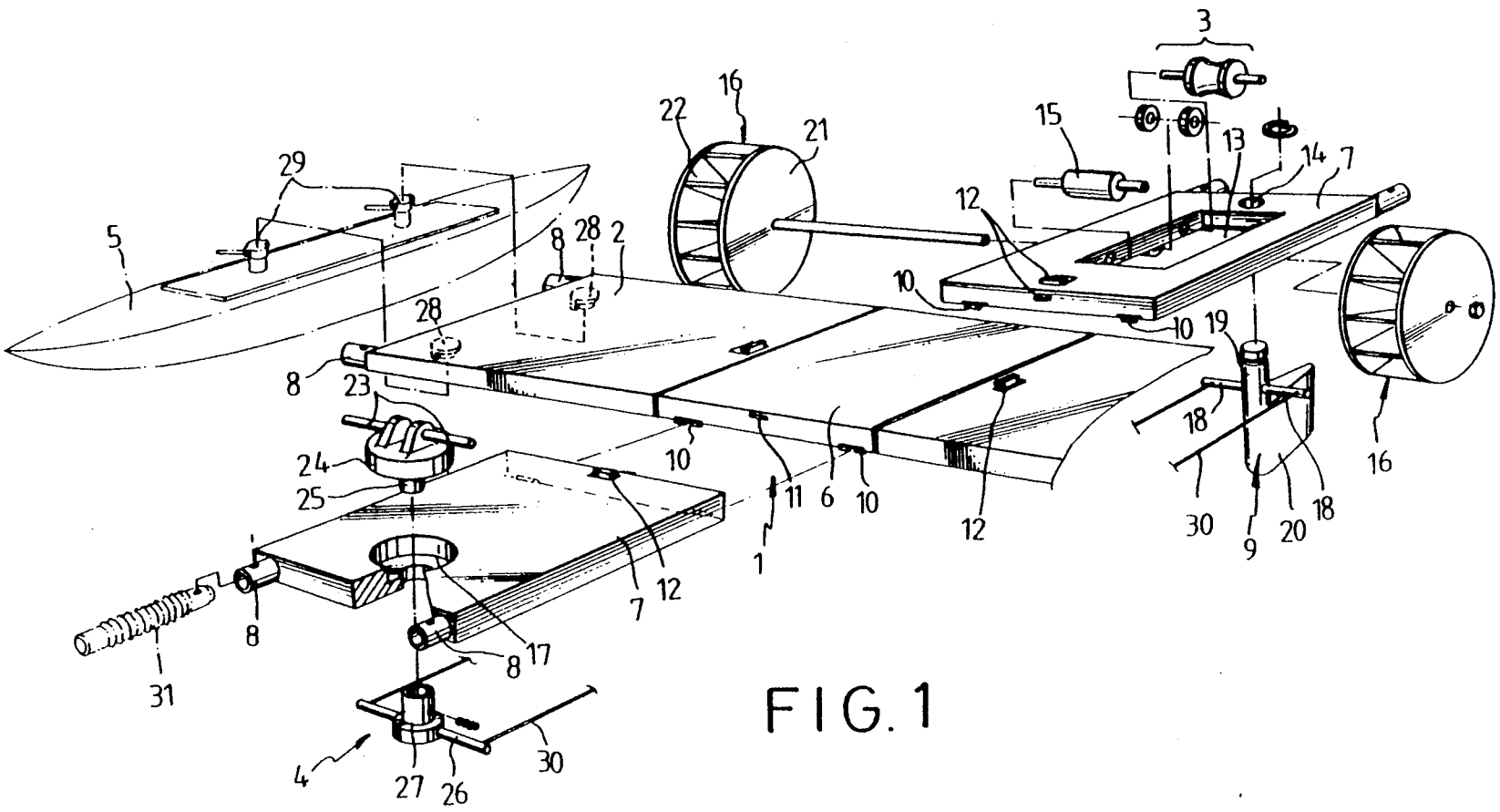
FIG. 1 is a perspective exploded view of a built-up watercraft according to the present invention.
Figure 2:
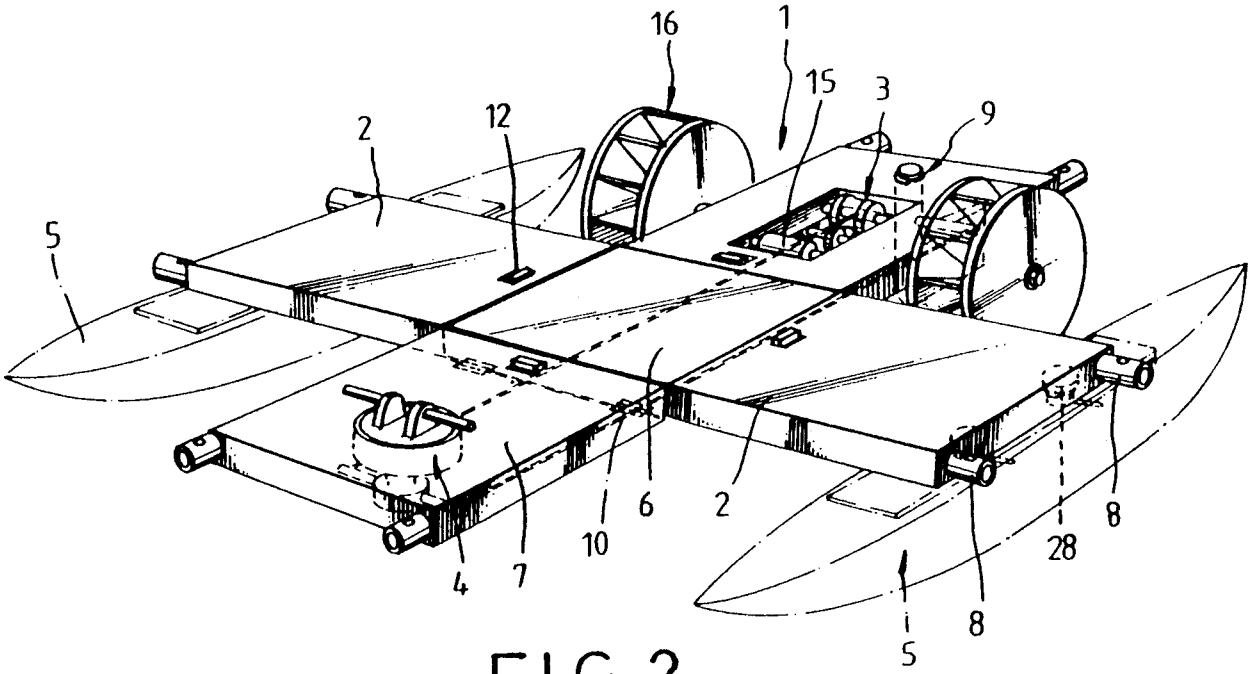
FIG. 2 is a perspective elevational view of the built-up watercraft.

Referring to FIGS. 1 and 2, a built-up watercraft as constructed in accordance with the present invention is generally comprised of a body 1, two wings 2, a transmission mechanism 3, a steering wheel assembly 4, and two floats 5.

The body 1 is comprised of a master base board 6 hinged between two auxiliary base boards 7 by hinges 10. The two wings 2 are bilaterally hinged to the master base board 6 by hinges 10. Therefore, the body 1 and the wings 2 are connected into the shape of a cross. The master base board 6 has staples (or retaining holes) 11 around the four sides thereof, on which hinged metal straps (or retainer devices) 12 on the auxiliary base boards 7 and the wings 2 are respectively locked. Each wing 2 has two lock holes 28 spaced from the master base board 6 and respectively locked to two locking devices 29 on either float 5 for permitting the body 1 to be supported on the two floats 5 by the wings 2. One of the two auxiliary base board 7 has a rectangular opening 13, which receives an idle wheel 15 and the transmission mechanism 3, and a small round hole 14, which receives a rudder assembly 9. The transmission mechanism 3 is coupled with two propeller runners 16 disposed at two opposite sides relative to the auxiliary base board 7, on which the transmission mechanism 3 is mounted. Each propeller runner 16 is comprised of a vane 22 coupled between two parallel wheels 21. Rotating the transmission mechanism 3 causes the propeller runners 16 to propel the body 1 in water. The rudder assembly 9 comprises a helm 18 fastened to a stem 19 on a rudder 20. The other auxiliary base board 7 has a countersunk hole 17, which receives the steering wheel assembly 4. The steering wheel assembly 4 comprises a handle 23, a rotary wheel 24 driven by the handle 23, a base 27 coupled to a bottom shaft 25 on the rotary wheel 24, and a cross rod 26 across the base 27 with two opposite ends thereof respectively connected to two opposite ends of the helm 18 by cables 30. Therefore, the direction of the rudder 20 of the rudder assembly 9 is adjusted by turning the handle 23 of the steering wheel assembly 4.

Figure 3:
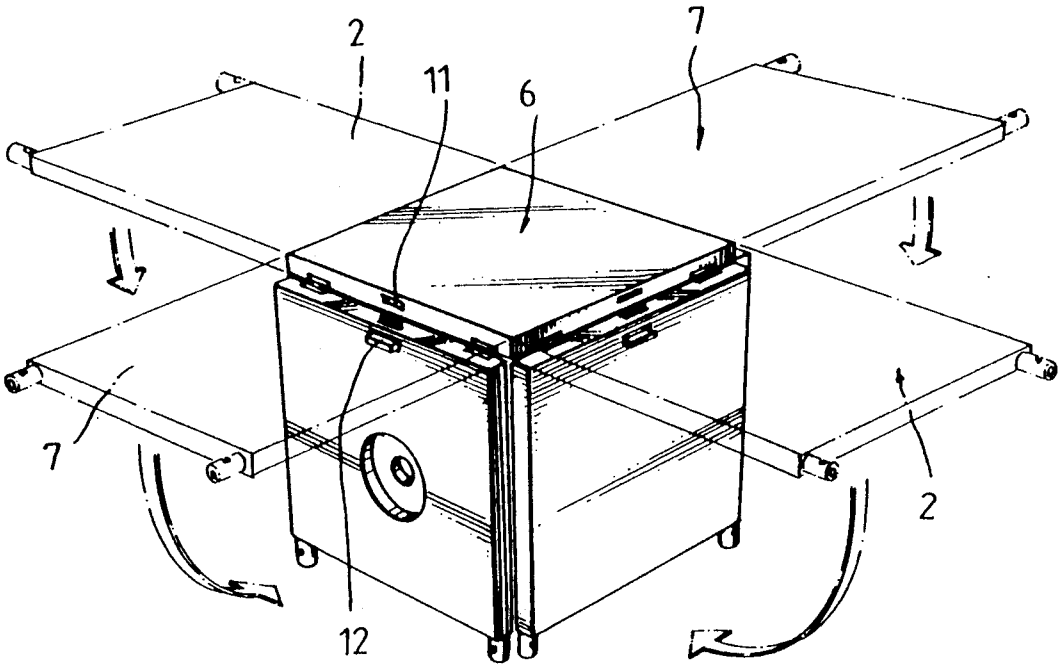
FIG. 3 illustrates the assembly of the body and wings of the watercraft folded up and formed into the shape of a case.

Referring to FIG. 3, as the auxiliary base boards 7 and the wings 2 are respectively hinged to the main base board 6 at the four sides thereof by respective hinges 10 and locked into shape by locking up the hinged metal straps (retainer devices) 12 on the auxiliary base boards 7 and the wings 2 with the staples (retaining holes) 11 on the main base board 6 respectively, the assembly of the body 1 and the wings 2 can be folded up into the shape of a rectangular case for holding the other parts and accessories of the watercraft, after the hinged metal straps (retainer devices) 12 have been respectively unfastened from the staples (retaining holes) 11, as the watercraft is not in use.

Figure 4:
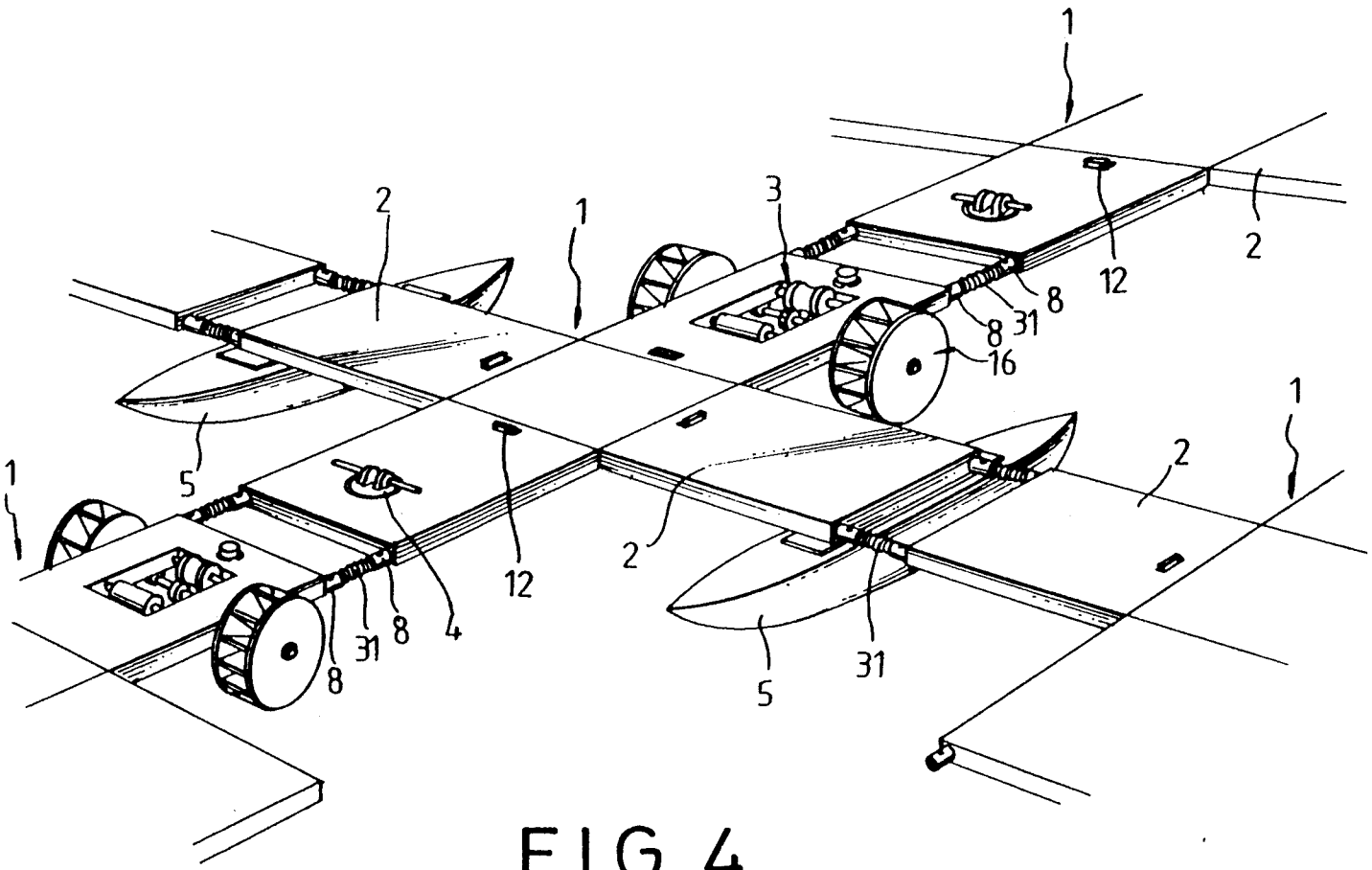
FIG. 4 illustrates a plurality of watercrafts of the same structure connected together longitudinally and transversely.

Referring to FIG. 4, each auxiliary base board 7 or wing 2 has a plurality of connecting tubes 8 spaced on an outer side for connecting either auxiliary base board 7 or wing 2 of another watercraft of the same structure by flexible connecting rods 31. Therefore, a plurality of watercrafts of the same structure can be connected in series as well as in parallel. Because the watercrafts are connected together by flexible rods 31, the connecting parts between either two watercrafts will not be broken as they are propelled to move through big water waves.

Figure 5:
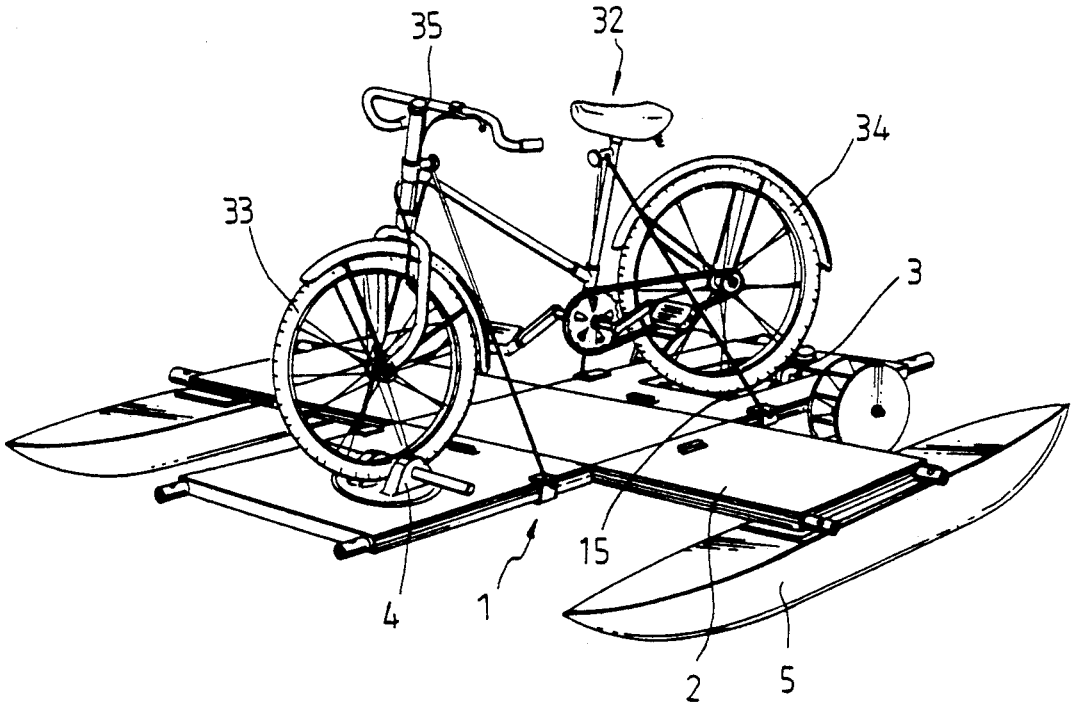
FIG. 5 illustrates an installed example showing a bicycle used as the power unit to drive the watercraft.
Figure 6:
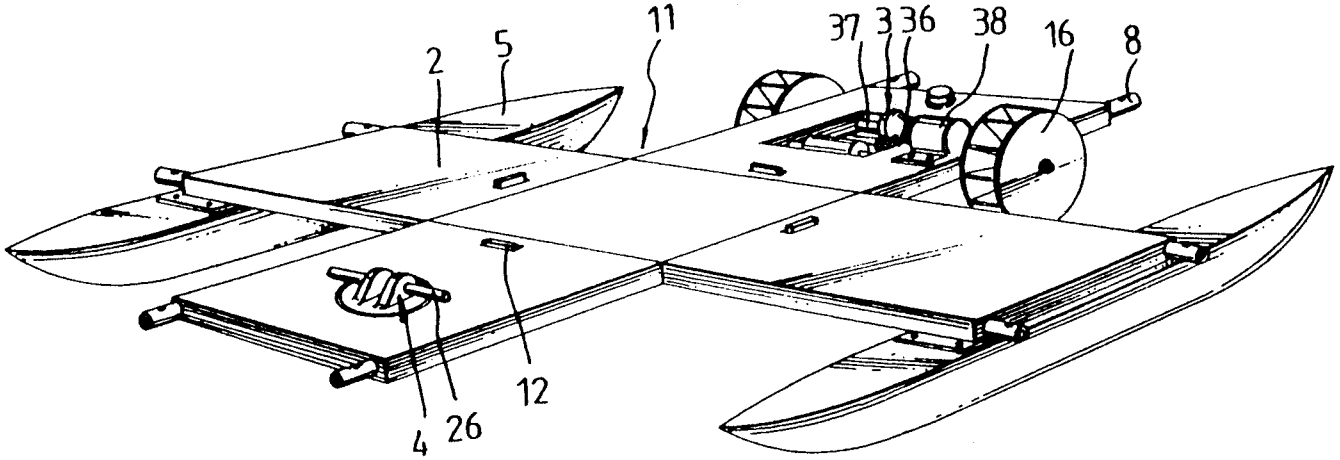
FIG. 6 illustrates another installed example showing an electric motor used as the power unit to drive the watercraft.

Referring to FIGS. 5 and 6, a power unit 32 (bicycle, electric motor, outboard engine, etc.) may be fastened to the body 1 to drive the propeller runners 16 through the transmission mechanism 3. In the installed example of FIG. 5, the power unit 32 is a bicycle, which has the front wheel 33 coupled to the steering wheel assembly 4, the rear wheel 34 mounted on the idle wheel 15 and the transmission mechanism 3. Therefore, running the bicycle causes the rear wheel 34 to rotate the propeller runners 16, through the transmission mechanism 3, in moving the watercraft. While pedaling the bicycle, the rudder 20 is controlled by the handlebar 35 of the bicycle through the steering wheel assembly 4. In the installed example of FIG. 6, the power unit 32 is an electric motor 38, which has an output shaft 36 coupled to a shaft 37 on the transmission mechanism 3. Turning on the electric motor 38 causes the transmission mechanism 3 to rotate the propeller runners 16 in moving the watercraft.

The embodiments described are simple in structure and therefore functional. However, it is to be understood that various modifications and changes could be made without departing from the scope of the invention and the invention is not to be considered limited to what is shown in the drawings and described in the specification.

What is claimed is:

1. A built-up watercraft comprised of a body, two wings, a transmission mechanism, a steering wheel assembly and two floats, wherein said body comprises a master base board hinged between a front auxiliary base board and a rear auxiliary base board by hinges and locked in place by locking devices, said rear auxiliary base board having a opening, which receives an idle wheel and said transmission mechanism, and a hole, which receives a rudder assembly, said front auxiliary base board having a further hole, which receives said steering wheel assembly; said steering wheel assembly is linked to said rudder assembly by cables for steering control; said transmission mechanism comprising two propeller runners disposed at two opposite sides relative to said body and driven by a power unit to propel the watercraft in water; said wings are bilaterally hinged to the master base board by hinges and locked on the same plane across said body by locks, each wing having an outer side fastened to either float by locking devices for permitting said body to be supported on said two floats; said front and rear auxiliary base boards and said two wings each having a plurality of connecting means on a respective outer side for connecting either wing or auxiliary base board of another watercraft of the same structure by flexible connecting rods.

2. The built-up watercraft of claim 1 wherein said locking devices are unlocked for permitting said floats to be detached from said wings, and for permitting said wings and said front and rear auxiliary base boards to be turned downwards on said master base board in forming into the shape of a case.

3. The built-up watercraft of claim 1 wherein the hole on said front auxiliary base board which receives said steering wheel assembly is a countersunk hole.

4. The built-up watercraft of claim 1 wherein said propeller runners each is comprised of a vane coupled between two parallel wheels.

5. The built-up watercraft of claim 1 wherein said rudder assembly comprises a helm fastened to a stem on a rudder and driven by said steering wheel assembly through said cables.

6. The built-up watercraft of claim 1 wherein said steering wheel assembly comprises a rotary wheel coupled with a handle, a base coupled to a bottom shaft on the rotary wheel, and a cross rod fastened to the base and linked to the helm of said rudder assembly by said cables.

7. The built-up watercraft of claim 1 wherein said front and rear auxiliary base boards and said two wings each has a plurality of connecting means on a respective outer side for connecting either wing or auxiliary base board of another watercraft of the same structure by flexible connecting rods for permitting a plurality of watercrafts of the same structure to be linked in series as well as in parallel.

* * * * *